US006760698B2

(12) United States Patent
Gao

(10) Patent No.: US 6,760,698 B2
(45) Date of Patent: Jul. 6, 2004

(54) SYSTEM FOR CODING SPEECH INFORMATION USING AN ADAPTIVE CODEBOOK WITH ENHANCED VARIABLE RESOLUTION SCHEME

(75) Inventor: Yang Gao, Mission Viejo, CA (US)

(73) Assignee: Mindspeed Technologies Inc., Newport Beach, CA (US)

( * ) Notice: Subject to any disclaimer, the term of this patent is extended or adjusted under 35 U.S.C. 154(b) by 605 days.

(21) Appl. No.: 09/782,383

(22) Filed: Feb. 12, 2001

(65) Prior Publication Data

US 2002/0147583 A1 Oct. 10, 2002

Related U.S. Application Data

(60) Provisional application No. 60/233,046, filed on Sep. 15, 2000.

(51) Int. Cl.[7] ..... G10L 11/04; G10L 19/04

(52) U.S. Cl. ..... 704/207; 704/219; 704/223

(58) Field of Search ..... 704/220, 212, 704/230, 224, 200, 207, 219, 223

(56) References Cited

U.S. PATENT DOCUMENTS 5,704,002 A 12/1997 Massaloux 5,963,898 A 10/1999 Navarro et al.

FOREIGN PATENT DOCUMENTS

WO WO 00 11653 A 3/2000

OTHER PUBLICATIONS

Bastiaan Kleijn et al., Interpolation of the Pitch–Predictor Parameters in Analysis–by–Synthesis Speech Coders IEEE Trans. Speech and Audio Processing Jan. 1994, vol. 2, pp. 45–47.*

* cited by examiner

*Primary Examiner*—Tālivaldis Ivars Šmits
*Assistant Examiner*—Jakieda R Jackson
(74) *Attorney, Agent, or Firm*—Farjami & Farjami LLP

(57) ABSTRACT

A speech coding system includes an adaptive codebook containing excitation vector data associated with corresponding adaptive codebook indices (e.g., pitch lags). Different excitation vectors in the adaptive codebook have distinct corresponding resolution levels. The resolution levels include a first resolution range of continuously variable or finely variable resolution levels. A gain adjuster scales a selected excitation vector data or preferential excitation vector data from the adaptive codebook. A synthesis filter synthesizes a synthesized speech signal in response to an input of the scaled excitation vector data. The speech coding system may be applied to an encoder, a decoder, or both.

32 Claims, 5 Drawing Sheets

SYSTEM FOR CODING SPEECH INFORMATION USING AN ADAPTIVE CODEBOOK WITH ENHANCED VARIABLE RESOLUTION SCHEME

CROSS REFERENCE TO RELATED APPLICATIONS

This application claims the benefit of provisional application serial No. 60/233,046, entitled SYSTEM FOR ENCODING SPEECH INFORMATION USING AN ADAPTIVE CODEBOOK WITH DIFFERENT RESOLUTION LEVELS, filed on Sep. 15, 2000 under 35 U.S.C. 119(e).

BACKGROUND OF THE INVENTION

1. Technical Field

This invention relates to a method and system for coding (e.g., encoding or decoding) speech information using an adaptive codebook with different resolution levels within a variable resolution scheme.

2. Related Art

Speech encoding may be used to increase the traffic handling capacity of an air interface of a wireless system. A wireless service provider generally seeks to maximize the number of active subscribers served by the wireless communications service for an allocated bandwidth of electromagnetic spectrum to maximize subscriber revenue. A wireless service provider may pay tariffs, licensing fees, and auction fees to governmental regulators to acquire or maintain the right to use an allocated bandwidth of frequencies for the provision of wireless communications services. Thus, the wireless service provider may select speech encoding technology to get the most return on its investment in wireless infrastructure.

Certain speech encoding schemes store a detailed database at an encoding site and a duplicate detailed database at a decoding site. Encoding infrastructure transmits reference data for indexing the duplicate detailed database to conserve the available bandwidth of the air interface. Instead of modulating a carrier signal with the entire speech signal at the encoding site, the encoding infrastructure merely transmits the shorter reference data that represents the original speech signal. The decoding infrastructure reconstructs a replica of the original speech signal by using the shorter reference data to access the duplicate detailed database at the decoding site.

The quality of the speech signal may be impacted if an insufficient variety of excitation vectors are present in the detailed database to accurately represent the speech underlying the original speech signal. The number of code identifiers supported by the maximum number of bits of the shorter reference data is one limitation on the variety of excitation vectors in the detailed database (e.g., codebook). Code identifiers may represent different values of pitch lags, or vice versa. Pitch lag refers to a temporal measurement of the repetition component (e.g., generally periodic waveform) that is observable in voiced speech or a voiced component of speech. Pitch lag values may be used as an index to search for or find excitation vectors in the detailed database. A granularity of the excitation vectors refers to a step size between adjacent cells of excitation vectors in the detailed database. Reducing the granularity of the excitation vectors may improve the quality of reproduction of the speech signal by reducing quantization error in the speech coding process. However, the granularity of the excitation vectors is generally limited to what can be represented by a fixed number of bits for transmission over the air interface to conserve spectral bandwidth.

The limited number of possible excitation vectors, represented by a fixed maximum number of bits, may not afford the accurate or intelligible representation of the speech signal by the excitation vectors. Accordingly, at times the reproduced speech may be artificial-sounding, distorted, unintelligible, or not perceptually palatable to subscribers. Thus, a need exists for enhancing the quality of reproduced speech, while adhering to the bandwidth constraints imposed by the transmission of reference or indexing information within a limited number of bits.

In one prior art configuration, the excitation vectors in the adaptive codebook may have a uniform resolution regardless of the actual value of the pitch lag. However, the proper selection of excitation vectors for lower pitch lag values often has a greater impact on the speech quality of the reproduced speech than the proper selection of excitation vectors for higher pitch lag values. Thus, a uniform resolution versus pitch lag may result in lower perceptual quality of the reproduced speech than otherwise possible.

In another prior art configuration, the excitation vectors in the adaptive codebook may have several discrete resolution levels that may be expressed as a coarse step function with coarse granularity. Although a coarse step function may be tailored to capture some voice quality benefits of the lower pitch lag values, the coarse step function provides reference to only a limited number of discrete excitation vectors. Accordingly, the discrete resolution levels may provide an inadequately accurate representation of the encoded speech signal because of quantization error. The coarse step function cannot generally be converted to a fine step function with fine granularity and improved speech reproduction because the number of bits allocated to the adaptive codebook indices is limited based on the available bandwidth or transmission capacity of the air interface. Thus, a need exists for associating adaptive codebook indexes with corresponding excitation vectors in a nonuniform quantization manner according to the pitch lag to enhance speech quality.

SUMMARY

A speech coding system features an enhanced variable resolution scheme with generally continuously variable or finely variable resolution levels for an intermediate range of pitch lags. The enhanced variable resolution scheme facilitates quality enhancement of reproduced speech, while conserving the available bandwidth of an air interface of a wireless system. The speech coding system reduces or minimizes the quantization error associated with the selection of excitation vectors because of the generally continuously variable nature or finely variable nature of the resolution levels within the intermediate range. Accordingly, the continuously variable or finely variable resolution levels contribute toward a faithful reproduction of an input speech signal. Further, the lower pitch lags within the intermediate range have a greater resolution than the higher pitch lags within the intermediate range to represent the perceptually significant portions of the input speech signal in an accurate manner.

The speech coding system may be applied to speech encoders, speech decoders, or both. For example, an encoder or decoder includes an adaptive codebook containing excitation vector data associated with corresponding adaptive codebook indices (e.g., pitch lags). Different excitation vectors in the adaptive codebook may have different resolution levels. The resolution levels include a first resolution range of generally continuously variable resolution levels or sufficiently finely variable resolution levels to provide a desired level of perceptual quality. A gain adjuster scales a selected excitation vector data or preferential excitation vector data from the adaptive codebook. A synthesis filter synthesizes a synthesized speech signal in response to an input of the scaled excitation vector data.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

Like reference numerals designate corresponding elements or procedures throughout the different figures.

DETAILED DESCRIPTION OF PREFERRED EMBODIMENTS

The term coding refers to encoding of a speech signal, decoding of a speech signal or both. An encoder codes or encodes a speech signal, whereas a decoder codes or decodes a speech signal. The encoder may determine coding parameters that are used both in an encoder to encode a speech signal and a decoder to decode the encoded speech signal.

Pitch lag refers a temporal measure of the repetition component that is apparent in voiced speech or a voiced component of a speech signal. For example, pitch lag may represent the time duration between adjacent amplitude peaks of a periodic component of the speech signal. The pitch lag may be determined for an interval, such as a frame or a sub-frame.

The adaptive codebook index refers to a unique code identifier for each of the pitch lags of the adaptive codebook. The unique code identifier selected from a maximum number of allowable code identifiers dependent upon bandwidth or transmission capacity limitations of an air interface.

A multi-rate encoder may include different encoding schemes to attain different transmission rates over an air interface. Each different transmission rate may be achieved by using one or more encoding schemes. The highest coding rate may be referred to as full-rate coding. A lower coding rate may include one-half-rate coding where the one-half-rate coding has a maximum transmission rate that is approximately one-half the maximum rate of the full-rate coding. An encoding scheme may include an analysis-by-synthesis encoding scheme in which an original speech signal is compared to a synthesized speech signal to optimize the perceptual similarities and/or objective similarities between the original speech signal and the synthesized speech signal. A code-excited linear predictive coding scheme (CELP) is one example of an analysis-by synthesis encoding scheme.

Figure 1:
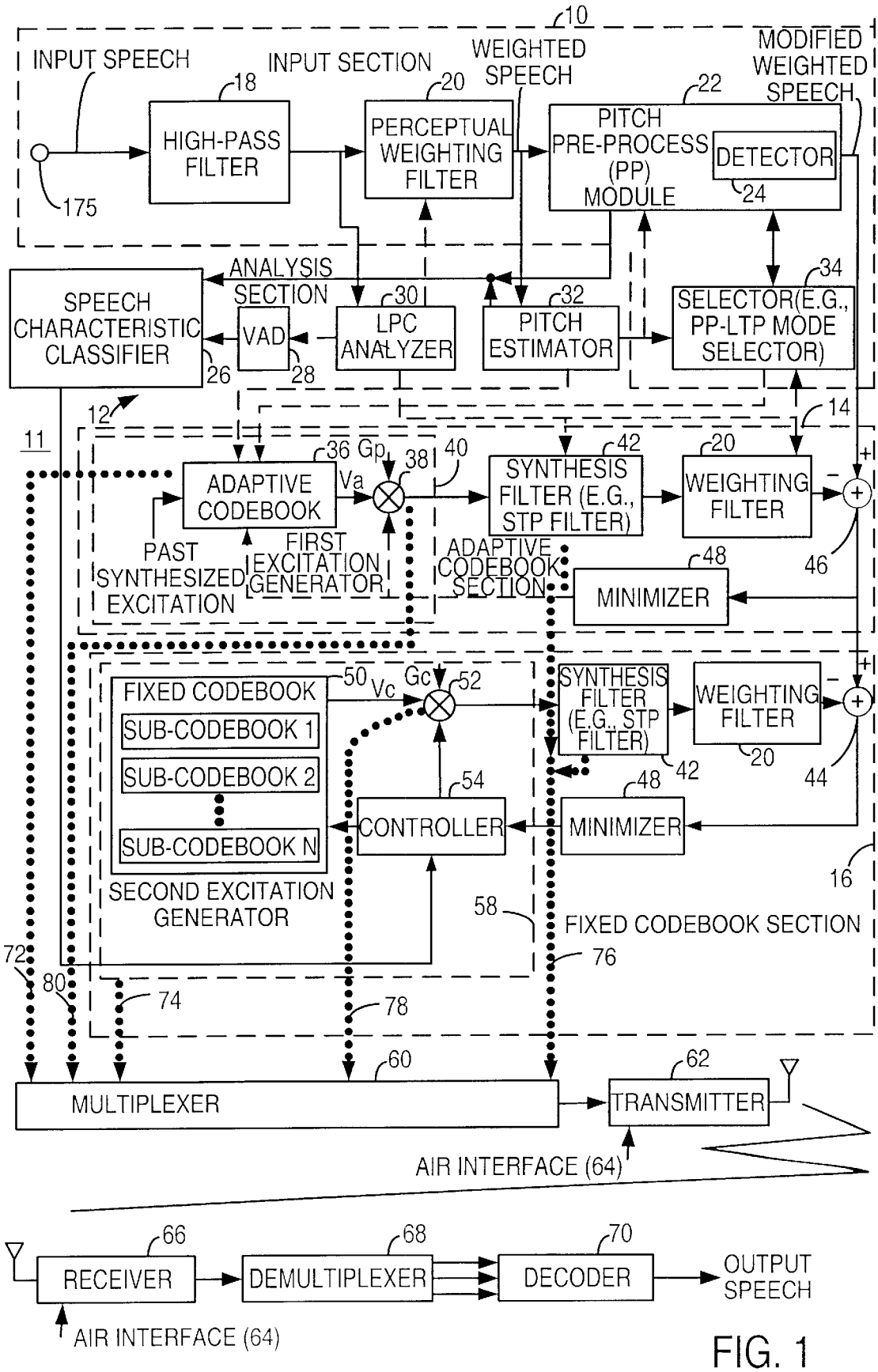
FIG. 1 is a block diagram of an encoding system.

FIG. 1 shows an encoder 11 including an input section 10 coupled to an analysis section 12 and an adaptive codebook section 14. In turn, the adaptive codebook section 14 is coupled to a fixed codebook section 16. A multiplexer 60, associated with both the adaptive codebook section 14 and the fixed codebook section 16, is coupled to a transmitter 62.

The transmitter 62 and a receiver 66 along with a communications protocol represent an air interface 64 of a wireless system. The input speech from a source or speaker is applied to the encoder 11 at the encoding site. The transmitter 62 transmits an electromagnetic signal (e.g., radio frequency or microwave signal) from an encoding site to a receiver 66 at a decoding site, which is remotely situated from the encoding site. The electromagnetic signal is modulated with reference information representative of the input speech signal. A demultiplexer 68 demultiplexes the reference information for input to the decoder 70. The decoder 70 produces a replica or representation of the input speech, referred to as output speech, at the decoder 70.

The input section 10 has an input terminal 175 for receiving an input speech signal. The input terminal 175 feeds a high-pass filter 18 that attenuates the input speech signal below a cut-off frequency (e.g., 80 Hz) to reduce noise in the input speech signal. The high-pass filter 18 feeds a perceptual weighting filter 20 and a linear predictive coding (LPC) analyzer 30. The perceptual weighting filter 20 may feed both a pitch pre-processing module 22 and a pitch estimator 32. Further, the perceptual weighting filter 20 may be coupled to an input of a first summer 46 via the pitch pre-processing module 22. The pitch pre-processing module 22 includes a detector 24 for detecting a triggering speech characteristic.

In one embodiment, the detector 24 may refer to a classification unit that (1) identifies noise-like unvoiced speech and (2) distinguishes between non-stationary voiced and stationary voiced speech in an interval of an input speech signal. In another embodiment, the detector 24 may be integrated into both the pitch pre-processing module 22 and a speech characteristic classifier 26. In yet another embodiment, the detector 24 may be integrated into the speech characteristic classifier 26, rather than the pitch pre-processing module 22. In the latter embodiment, the speech characteristic classifier 26 is coupled to a selector 34.

The analysis section 12 includes the LPC analyzer 30, the pitch estimator 32, a voice activity detector 28, and the speech characteristic classifier 26. The LPC analyzer 30 is coupled to the voice activity detector (VAD) 28 for detecting the presence of speech or silence in the input speech signal. The pitch estimator 32 is coupled to a mode selector 34 for selecting a pitch pre-processing procedure or a responsive long-term prediction procedure based on input (e.g., the presence or absence of a defined signal characteristic) received from the detector 24.

The adaptive codebook section 14 includes a first excitation generator 40 coupled to a synthesis filter 42 (e.g., short-term predictive filter). In turn, the synthesis filter 42 feeds a perceptual weighting filter 20. The weighting filter 20 of the adaptive codebook section 14 may be coupled to an input of the first summer 46, whereas a minimizer 48 is coupled to an output of the first summer 46. The minimizer 48 provides a feedback command to the first excitation generator 40 to minimize an error signal at the output of the first summer 46. The minimization of the error signal is used to determine an appropriate excitation vector from the adaptive codebook 36 or at least a code identifier representative of the appropriate excitation vector. The adaptive codebook section 14 may be coupled to the fixed codebook section 16 where the output of the first summer 46 feeds the input of a second summer 44 with the error signal.

The fixed codebook section 16 includes a second excitation generator 58 coupled to a synthesis filter 42 (e.g., short-term predictive filter). In turn, the synthesis filter 42 feeds a perceptual weighting filter 20. The weighting filter 20 of the fixed codebook section 16 is coupled to an input of the second summer 44, whereas a minimizer 48 is coupled to an output of the second summer 44. A residual signal is present on the output of the second summer 44. The minimizer 48 provides a feedback command to the second excitation generator 58 to minimize the residual signal. The minimization of the residual signal facilitates the selection of an appropriate excitation vector from the fixed codebook 50.

Other embodiments exist that provide for alternative arrangements in structure and operation of the invention. In one embodiment, the synthesis filter 42 and the perceptual weighting filter 20 of the adaptive codebook section 14 may be combined into a single filter. In another embodiment, the synthesis filter 42 and the perceptual weighting filter 20 of the fixed codebook section 16 may be combined into a single filter. In yet another alternate embodiment, the three perceptual weighting filters 20 of the encoder may be replaced by two perceptual weighting filters 20, where each perceptual weighting filter 20 is coupled in tandem with the input of one of the minimizers 48. Accordingly, in the latter alternative embodiment, the perceptual weighting filter 20 from the input section 10 is deleted.

In FIG. 1, an input speech signal is inputted into the input section 10. The input section 10 decomposes speech into component parts including (1) a short-term component or envelope of the input speech signal, (2) a long-term component or pitch lag of the input speech signal, and (3) a residual component that results from the removal of the short-term component and the long-term component from the input speech signal. The encoder 11 uses the long-term component, the short-term component, and the residual component to facilitate searching for the preferential excitation vectors of the adaptive codebook 36 and the fixed codebook 50 to represent the input speech signal as reference information for transmission over the air interface 64.

The perceptual weighing filter 20 of the input section 10 has a first time versus amplitude response that opposes a second time versus amplitude response of the formants of the input speech signal. The formants represent key amplitude versus frequency responses of the speech signal that characterize the speech signal consistent with an linear predictive coding analysis of the LPC analyzer 30. The perceptual weighting filter 20 is adjusted to compensate for the perceptually induced deficiencies in error minimization, that would otherwise result, between the reference speech signal (e.g., input speech signal) and a synthesized speech signal.

The input speech signal is provided to a linear predictive coding (LPC) analyzer 30 (e.g., LPC analysis filter) to determine LPC coefficients for the synthesis filters 42 (e.g., short-term predictive filters). The input speech signal is inputted into a pitch estimator 32. The pitch estimator 32 determines a pitch lag value and a pitch gain coefficient for voiced segments of the input speech. Voiced segments of the input speech signal refer to generally periodic waveforms.

The pitch estimator 32 may perform an open-loop pitch analysis at least once a frame to estimate the pitch lag. Pitch lag refers a temporal measure of the repetition component (e.g., a generally periodic waveform) that is apparent in voiced speech or voice component of a speech signal. For example, pitch lag may represent the time duration between adjacent amplitude peaks of a generally periodic speech signal. As shown in FIG. 1, the pitch lag may be estimated based on the weighted speech signal. Alternatively, pitch lag may be expressed as a pitch frequency in the frequency domain, where the pitch frequency represents a first harmonic of the speech signal.

The pitch estimator 32 maximizes the correlations between signals occurring in different sub-frames to determine candidates for the estimated pitch lag. The pitch estimator 32 preferably divides the candidates within a group of distinct ranges of the pitch lag. After normalizing the delays among the candidates, the pitch estimator 32 may select a representative pitch lag from the candidates based on one or more of the following factors: (1) whether a previous frame was voiced or unvoiced with respect to a subsequent frame affiliated with the candidate pitch delay; (2) whether a previous pitch lag in a previous frame is within a defined range of a candidate pitch lag of a subsequent frame, and (3) whether the previous two frames are voiced and the two previous pitch lags are within a defined range of the subsequent candidate pitch lag of the subsequent frame. The pitch estimator 32 provides the estimated representative pitch lag to the adaptive codebook 36 to facilitate a starting point for searching for the preferential excitation vector in the adaptive codebook 36.

The speech characteristic classifier 26 preferably executes a speech classification procedure in which speech is classified into various classifications during an interval for application on a frame-by-frame basis or a subframe-by-subframe basis. The speech classifications may include one or more of the following categories: (1) silence/background noise, (2) noise-like unvoiced speech, (3) unvoiced speech, (4) transient onset of speech, (5) plosive speech, (6) non-stationary voiced, and (7) stationary voiced. Stationary voiced speech represents a periodic component of speech in which the pitch (frequency) or pitch lag does not vary by more than a maximum tolerance during the interval of consideration. Nonstationary voiced speech refers to a periodic component of speech where the pitch (frequency) or pitch lag varies more than the maximum tolerance during the interval of consideration. Noise-like unvoiced speech refers to the nonperiodic component of speech that may be modeled as a noise signal, such as Gaussian noise. The transient onset of speech refers to speech that occurs immediately after silence of the speaker or after low amplitude excursions of the speech signal. The speech characteristic classifier 26 may accept a raw input speech signal, pitch lag, pitch correlation data, and voice activity detector data to classify the raw speech signal as one of the foregoing classifications for an associated interval, such as a frame or a subframe.

A first excitation generator 40 includes an adaptive codebook 36 and a first gain adjuster 38 (e.g., a first gain codebook). A second excitation generator 58 includes a fixed codebook 50, a second gain adjuster 52 (e.g., second gain codebook), and a controller 54 coupled to both the fixed codebook 50 and the second gain adjuster 52. The fixed codebook 50 and the adaptive codebook 36 define excitation vectors. Once the LPC analyzer 30 determines the filter parameters of the synthesis filters 42, the encoder 11 searches the adaptive codebook 36 and the fixed codebook 50 to select proper excitation vectors. The first gain adjuster 38 may be used to scale the amplitude of the excitation vectors of the adaptive codebook 36. The second gain adjuster 52 may be used to scale the amplitude of the excitation vectors in the fixed codebook 50. The controller 54 uses speech characteristics from the speech characteristic classifier 26 to assist in the proper selection of preferential excitation vectors from the fixed codebook 50, or a sub-codebook therein.

The adaptive codebook 36 may include excitation vectors that represent segments of waveforms or other energy representations. The excitation vectors of the adaptive codebook 36 may be geared toward reproducing or mimicking the long-term variations of the speech signal. A previously synthesized excitation vector of the adaptive codebook 36 may be inputted into the adaptive codebook 36 to determine the parameters of the present excitation vectors in the adaptive codebook 36. For example, the encoder 11 may alter the present excitation vectors in the adaptive codebook 36 in response to the input of past excitation vectors outputted by the adaptive codebook 36, the fixed codebook 50, or both. The adaptive codebook 36 is preferably updated on a frame-by-frame or a subframe-by-subframe basis based on a past synthesized excitation, although other update intervals may produce acceptable results and fall within the scope of the invention.

The excitation vectors in the adaptive codebook 36 are associated with corresponding adaptive codebook indices. In one embodiment, the adaptive codebook indices may be equivalent to pitch lag values. The pitch estimator 32 initially determines a representative pitch lag in the neighborhood of the preferential pitch lag value or preferential adaptive index. A preferential pitch lag value minimizes an error signal at the output of the first summer 46, consistent with a codebook search procedure. The granularity of the adaptive codebook index or pitch lag is generally limited to a fixed number of bits for transmission over the air interface 64 to conserve spectral bandwidth. Spectral bandwidth may represent the maximum bandwidth of electromagnetic spectrum permitted to be used for one or more channels (e.g., downlink channel, an uplink channel, or both) of a communications system. For example, the pitch lag information may need to be transmitted in 7 bits for half-rate coding or 8-bits for full-rate coding of voice information on a single channel to comply with bandwidth restrictions. Thus, 128 states are possible with 7 bits and 256 states are possible with 8 bits to convey the pitch lag value used to select a corresponding excitation vector from the adaptive codebook 36.

The encoder 11 may apply different excitation vectors from the adaptive codebook 36 on a frame-by-frame basis, a subframe-by-subframe basis, or another suitable interval. Similarly, the filter coefficients of one or more synthesis filters 42 may be altered or updated on a frame-by-frame basis or another suitable interval. However, the filter coefficients preferably remain static during the search for or selection of each preferential excitation vector of the adaptive codebook 36 and the fixed codebook 50. In practice, a frame may represent a time interval of approximately 20 milliseconds and a sub-frame may represent a time interval within a range from approximately 5 to 10 milliseconds, although other durations for the frame and sub-frame fall within the scope of the invention.

The adaptive codebook 36 is associated with a first gain adjuster 38 for scaling the gain of excitation vectors in the adaptive codebook 36. The gains may be expressed as scalar quantities that correspond to corresponding excitation vectors. In an alternate embodiment, gains may be expressed as gain vectors, where the gain vectors are associated with different segments of the excitation vectors of the fixed codebook 50 or the adaptive codebook 36.

The first excitation generator 40 is coupled to a synthesis filter 42. The first excitation vector generator 40 may provide a long-term predictive component for a synthesized speech signal by accessing appropriate excitation vectors of the adaptive codebook 36. The synthesis filter 42 outputs a first synthesized speech signal based upon the input of a first excitation signal from the first excitation generator 40. In one embodiment, the first synthesized speech signal has a long-term predictive component contributed by the adaptive codebook 36 and a short-term predictive component contributed by the synthesis filter 42.

The first synthesized signal is compared to a weighted input speech signal. The weighted input speech signal refers to an input speech signal that has at least been filtered or processed by the perceptual weighting filter 20. As shown in FIG. 1, the first synthesized signal and the weighted input speech signal are inputted into a first summer 46 to obtain an error signal. A minimizer 48 accepts the error signal and minimizes the error signal by adjusting (i.e., searching for and applying) the preferential selection of an excitation vector in the adaptive codebook 36, by adjusting a preferential selection of the first gain adjuster 38 (e.g., first gain codebook), or by adjusting both of the foregoing selections. A preferential selection of the excitation vector and the gain scalar (or gain vector) apply to a subframe or an entire frame of transmission to the decoder 70 over the air interface 64. The filter coefficients of the synthesis filter 42 remain fixed during the adjustment or search for each distinct preferential excitation vector and gain vector.

The second excitation generator 58 may generate an excitation signal based on selected excitation vectors from the fixed codebook 50. The fixed codebook 50 may include excitation vectors that are modeled based on energy pulses, pulse position energy pulses, Gaussian noise signals, or any other suitable waveforms. The excitation vectors of the fixed codebook 50 may be geared toward reproducing the short-term variations or spectral envelope variation of the input speech signal. Further, the excitation vectors of the fixed codebook 50 may contribute toward the representation of noise-like signals, transients, residual components, or other signals that are not adequately expressed as long-term signal components.

The excitation vectors in the fixed codebook 50 are associated with corresponding fixed codebook indices 74. The fixed codebook indices 74 refer to addresses in a database, in a table, or references to another data structure where the excitation vectors are stored. For example, the fixed codebook indices 74 may represent memory locations or register locations where the excitation vectors are stored in electronic memory of the encoder 11.

The fixed codebook 50 is associated with a second gain adjuster 52 for scaling the gain of excitation vectors in the fixed codebook 50. The gains may be expressed as scalar quantities that correspond to corresponding excitation vectors. In an alternate embodiment, gains may be expressed as gain vectors, where the gain vectors are associated with different segments of the excitation vectors of the fixed codebook 50 or the adaptive codebook 36.

The second excitation generator 58 is coupled to a synthesis filter 42 (e.g., short-term predictive filter), that may be referred to as a linear predictive coding (LPC) filter. The synthesis filter 42 outputs a second synthesized speech signal based upon the input of an excitation signal from the second excitation generator 58. As shown, the second synthesized speech signal is compared to a difference error signal outputted from the first summer 46. The second synthesized signal and the difference error signal are inputted into the second summer 44 to obtain a residual signal at the output of the second summer 44. A minimizer 48 accepts the residual signal and minimizes the residual signal by adjusting (i.e., searching for and applying) the preferential selection of an excitation vector in the fixed codebook 50, by adjusting a preferential selection of the second gain adjuster 52 (e.g., second gain codebook), or by adjusting both of the foregoing selections. A preferential selection of the excitation vector and the gain scalar (or gain vector) apply to a subframe, an entire frame, or another suitable interval. The filter coefficients of the synthesis filter 42 remain fixed during the adjustment.

The LPC analyzer 30 provides filter coefficients for the synthesis filter 42 (e.g., short-term predictive filter). For example, the LPC analyzer 30 may provide filter coefficients based on the input of a reference excitation signal (e.g., no excitation signal) to the LPC analyzer 30. Although the difference error signal is applied to an input of the second summer 44, in an alternate embodiment, the weighted input speech signal may be applied directly to the input of the second summer 44 to achieve substantially the same result as described above.

The preferential selection of a vector from the fixed codebook 50 preferably minimizes the quantization error among other possible selections in the fixed codebook 50. Similarly, the preferential selection of an excitation vector from the adaptive codebook 36 preferably minimizes the quantization error among the other possible selections in the adaptive codebook 36. Once the preferential selections are made in accordance with FIG. 1, a multiplexer 60 multiplexes the fixed codebook index 74, the adaptive codebook index 72, the first gain indicator (e.g., first codebook index), the second gain indicator (e.g., second codebook gain), and the filter coefficients associated with the selections to form reference information. The filter coefficients may include filter coefficients for one or more of the following filters: at least one of the synthesis filters 42, the perceptual weighing filter 20 and other applicable filters.

A transmitter 62 or a transceiver is coupled to the multiplexer 60. The transmitter 62 transmits the reference information from the encoder 11 to a receiver 66 via an electromagnetic signal (e.g., radio frequency or microwave signal) of a wireless system as illustrated in FIG. 1. The multiplexed reference information may be transmitted to provide updates on the input speech signal on a subframe-by-subframe basis, a frame-by-frame basis, or at other appropriate time intervals consistent with bandwidth constraints and perceptual speech quality goals.

The receiver 66 is coupled to a demultiplexer 68 for demultiplexing the reference information. In turn, the demultiplexer 68 is coupled to a decoder 70 for decoding the reference information into an output speech signal. As shown in FIG. 1, the decoder 70 receives reference information transmitted over the air interface 64 from the encoder 11. The decoder 70 uses the received reference information to create a preferential excitation signal. The reference information facilitates accessing of a duplicate adaptive codebook and a duplicate fixed codebook to those at the decoder 70. One or more excitation generators of the decoder 70 apply the preferential excitation signal to a duplicate synthesis filter. The same values or approximately the same values are used for the filter coefficients at both the encoder 11 and the decoder 70. The output speech signal, obtained from the contributions of the duplicate synthesis filter and the duplicate adaptive codebooks, is a replica or representation of the input speech inputted into the encoder 11. Thus, the reference data is transmitted over an air interface 64 in a bandwidth efficient manner because the reference data is composed of less bits, words, or bytes than the original speech signal inputted into the input section 10.

In an alternate embodiment, certain filter coefficients are not transmitted from the encoder to the decoder, where the filter coefficients are established in advance of the transmission of the speech information over the air interface 64 or are updated in accordance with internal symmetrical states and algorithms of the encoder and the decoder.

Figure 2:
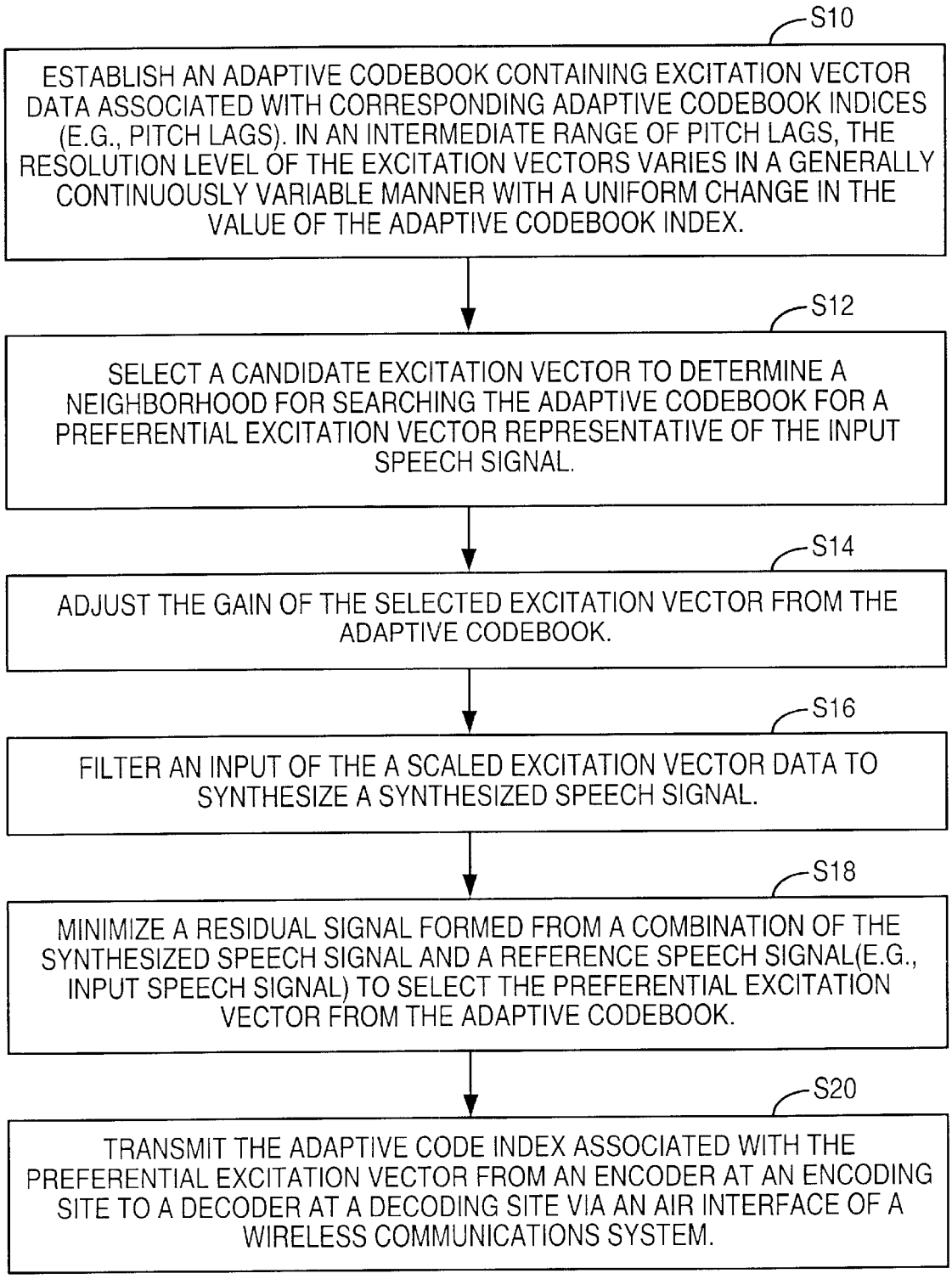
FIG. 2 is flow chart of a method of encoding that includes managing an adaptive codebook.

FIG. 2 shows a flow chart of a method for encoding a speech signal in accordance with the invention. The method starts in step S10.

In step S10, an adaptive codebook (e.g., adaptive codebook 36) is established containing excitation vector data associated with corresponding adaptive codebook indices. The adaptive codebook indices are associated with corresponding pitch lag values. An adaptive codebook index may be expressed as an n-bit word (e.g., 0001010) per frame or subframe that represents a certain pitch lag value (e.g., 50 samples), where n is any positive integer determined by bandwidth or transmission capacity constraints of the air interface 64 of the wireless system.

The adaptive codebook 36 may include multiple ranges of adaptive codebook indices or pitch lag values. In one example, in an intermediate range of pitch lags, a resolution of the excitation vector data varies in a generally continuous manner versus a uniform change in the pitch lag values or the associated adaptive codebook indices. Generally continuously variable means the resolution values vary from each other throughout at least a majority (e.g., the entirety) of pitch lag values within a defined range of pitch lag values. In another example in an intermediate range of pitch lags, a resolution of the excitation vector data varies in a finely variable nature versus a uniform change in the pitch lag values. Finely variable refers to resolution levels that vary from each other in discrete steps that are sufficiently small to approach a continuously variable response or to support a desired high level of perceptual quality of the reproduced speech.

In one embodiment, the adaptive codebook indices or pitch lag values include three distinct ranges: a first pitch lag range, a second pitch lag range, and a third pitch lag range. The first pitch lag range represents an intermediate range of pitch lags. The second pitch lag range represents a lower range of pitch lags. The third pitch lag range represents a higher range of pitch lags. The first pitch lag range is preferably bounded by the second pitch lag range and the third pitch lag range.

In general, the first pitch lag range is associated with a corresponding first resolution range or a first granularity range. The second pitch lag range is associated with a corresponding second resolution range or a second granularity range. The third pitch lag range is associated with a corresponding third resolution range or a third granularity range.

Figure 3:
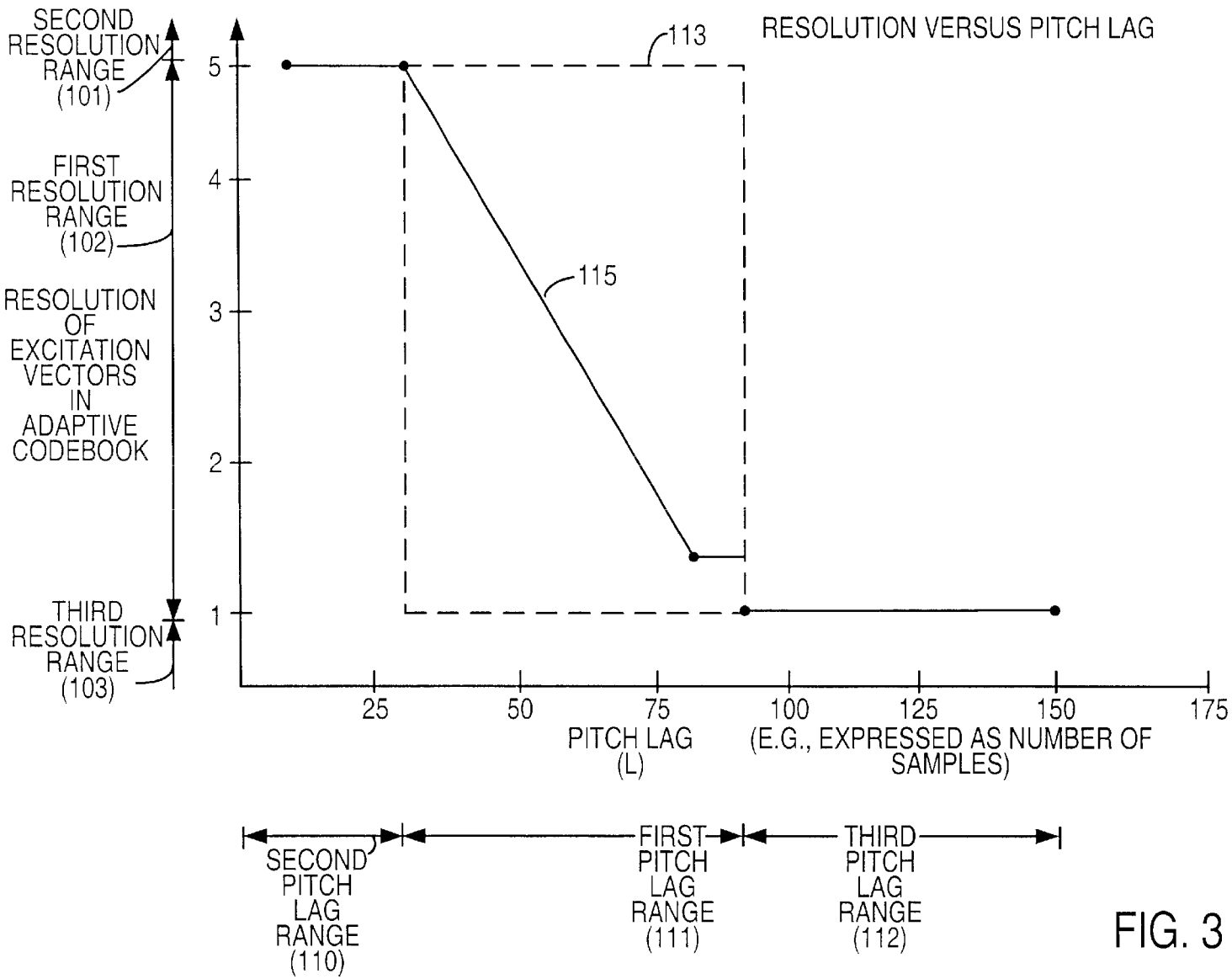
FIG. 3 is a graph of resolution versus pitch lag.

In one embodiment within the first pitch lag range, the resolution level of the excitation vectors is generally continuously variable or finely variable for a uniform change in the pitch lag value. Within the second pitch lag range, the excitation vectors have a generally constant resolution, although other embodiments may differ. Within the third pitch lag range, the excitation vectors have a generally constant resolution that is less than the resolution of the second pitch lag range, although other embodiments may differ. FIG. 3 shows various illustrative examples of pitch lag ranges and associated resolution ranges that may be used to practice the method of FIG. 2. FIG. 3 is subsequently described in greater detail.

In step S12, the encoder 11 selects a candidate excitation vector that provides a starting point or neighborhood for searching the adaptive codebook 36 for a preferential excitation vector representative of the input speech signal. For the selection of the candidate excitation vector, the pitch estimator 32 may estimate a pitch lag value for a frame or subframe of the weighted speech signal. The estimated pitch lag value is associated with a corresponding adaptive codebook index that the first excitation generator 40 uses to access or identify the candidate excitation vector in the adaptive codebook 36. The adaptive codebook 36 addresses the long-term predictive coding aspects of the speech signal.

In step S14, a gain adjuster 38 of the encoder 11 scales selected excitation vector data from the adaptive codebook 36. The selected excitation vector may represent the candidate vector or a preferential excitation vector that minimizes an error signal, a perceptually weighted error signal, or the like. The gain adjuster 38 may access a gain codebook to adjust the amplitude of the selected excitation vector data.

In step S16 after step S14, a synthesis filter 42 outputs a synthesized speech signal in response to an input of the scaled excitation vector data. The synthesis filter 42 may provide a reproduction of at least a voiced component of the original input speech signal inputted into the encoder 11. The synthesis filter 42 feeds a summer 46 or combiner that subtracts the synthesized speech signal from a reference speech signal. In one embodiment, the reference speech signal comprises a perceptually weighted speech signal.

In step S18, a minimizer 48 minimizes a residual signal formed from a subtractive combination of the synthesized speech signal and a reference speech signal to select the selected excitation vector from the adaptive codebook 36. The synthesized speech signal, the reference signal, or both may be perceptually weighted prior to the minimizing to enhance the perceptual quality of the reproduced speech.

In step S20, the encoder 11 transmits the adaptive code index (per frame or subframe) associated with the preferential excitation vector from an encoder 11 at an encoding site to a decoder 70 at a decoding site via an air interface 64 of a wireless communications system. In practice, a multiplexer 60 multiplexes the adaptive code index with a fixed codebook index, gain indicators, filter coefficients, or other applicable reference information in a manner consistent with the bandwidth limitations of the air interface 64 or a communications channel supported by the wireless communications system.

In one example of an encoding scheme for practicing the invention, four frame types are defined with different bit or storage unit assignments per frame of a transmission between an encoder 11 and a decoder 70. For full-rate encoding, in accordance with a first frame type, the adaptive code indices (or corresponding, pitch lag values) are represented by eight bits per subframe for absolute values and five bits per subframe for differential values based on previous absolute value. For full-rate encoding, in accordance with a second frame type, the pitch lag values are represented by eight bits per a frame. For half-rate encoding, in accordance with a third frame type, the adaptive codebook indices (or corresponding pitch lag values)are represented by 14 bits per frame. The third frame type preferably includes two subframes. An adaptive codebook index for each of the subframes may be represented by 7 bits. For the subframes, the adaptive codebook represents an integer pitch lag search. In accordance with a fourth frame type, the pitch lag values for frames are represented by 7 bits. For quarter-rate coding and eighth-rate coding, no adaptive codebook may be used.

The transmitter 62 transmits the pitch lag value or the adaptive codebook index from an encoder to a decoder via an air interface 64. The pitch lag or adaptive codebook index is represented by a maximum number of bits for transmission over the air interface 64 to limit the bandwidth of the transmission to a desired bandwidth. The decoder 70 accesses a duplicate adaptive codeboook associated with the decoder 70 to retrieve an applicable one of the excitation vectors for decoding an encoded speech signal based on the transmitted pitch lag value.

FIG. 3 shows the resolution of different codebook entries (i.e., excitation vectors) of the adaptive codebook versus the pitch lag. The vertical axis represent the resolution of the of excitation vectors, which is equivalent to the reciprocal of the granularity between entries of excitation vectors in the adaptive codebook. The granularity between entries may be expressed as a distance (e.g., a normalized distance) between adjacent cells of the excitation vectors. The horizontal axis represents pitch lag. The units on the horizontal axis may comprise a number of samples or another measure of time. Each sample has a duration that is less than the duration of a frame or a sub-frame. The pitch lag may be expressed as integer number of samples of a speech signal or fractions of samples reference to the nearest integer, for example.

As shown in FIG. 3, a first pitch lag range 111 is bounded by a second pitch lag range 110 and a third pitch lag range 112. The first pitch lag range 111 represents an intermediate range of pitch lags. The second pitch lag range 110 represents a lower range of pitch lags. The third pitch lag range 112 represents a higher range of pitch lags.

The resolution of the excitation vectors in the first pitch lag range 111 (e.g., intermediate range) varies in a generally continuous or uninterrupted manner with a change in pitch lag value. In general, generally continuously variable resolution levels vary from one another throughout at least a majority of the first pitch lag range. For example, as shown in FIG. 3, the generally continuously variable resolution levels vary from one another throughout a substantial entirety of the first pitch lag range.

Within the first pitch lag range 111 or a region 113, indicated by the dashed lines, the continuously variable resolution preferably has a higher resolution for excitation vectors associated with shorter pitch lags than for higher pitch lags to improve the perceptual quality of the reproduced speech. The first pitch lag range 111 is associated with a corresponding first resolution range 102. The first pitch lag range 111 and the first resolution range 102 collectively form the region 113 that contains a relationship of resolution of excitation vector data versus pitch lag in which the resolution varies in a generally continuously variable manner.

The first pitch lag range 111 is bounded by a second pitch lag range 110 of lower pitch lag values than those of the first pitch lag range 111. The second pitch lag range 110 has at least one resolution level equal to or higher than the generally continuously variable resolution levels of the first pitch lag range 110. The second pitch lag range 110 is associated with a second resolution range 101. As illustrated in FIG. 3, the resolution in the second resolution range 101 is generally constant.

The first pitch lag range 111 is bounded by a third pitch lag range 112 of higher pitch lag values than those of the second pitch lag range 110. The third pitch lag range 112 has at least one resolution level equal to or lower than the generally continuously variable resolution levels of the first pitch lag range 111. The third pitch lag range 112 is associated with the third resolution range 103. As illustrated in FIG. 3, the resolution of the third resolution range 103 is generally constant.

In accordance with one example, the first pitch lag range 111 and a first resolution range 102 cooperate to define the region 113 that contains a generally linear segment of resolution of excitation vector data versus pitch lag values. The slope of the generally linear segment is sloped to provide a higher resolution of excitation vectors for lower pitch lag values within the intermediate range of pitch lags. Although the first pitch lag range 111 contains a generally linear segment to express the relationship between pitch lag and resolution, in an alternate embodiment, the first pitch lag range may contain a generally curved segment to indicate the relationship between pitch lag and resolution where the resolution of the excitation vectors is higher for lower corresponding values of pitch lag.

In one embodiment, the resolution of the excitation vectors in the second pitch lag range 110 (e.g., lower pitch lag range) and the third pitch lag range 112 (e.g., upper range) remain generally constant with a change in the pitch lag value. The excitation vectors associated with the second pitch lag range 110 have a higher resolution than the excitation vectors associated with the third pitch lag range 112.

Although the boundaries between the pitch lag ranges are defined by the following pitch lag values for the illustrative example of FIG. 3, other values for the boundaries fall within the scope of the invention. The first pitch lag range 111, the second pitch lag range 110, and the third pitch lag range 112 collectively extend from a pitch lag value within a range of approximately 17 samples to 148 samples of the input speech signal. The first pitch lag range 111 extends between a pitch lag value within a range from approximately 34 to approximately 90 samples. The second pitch lag range 110 extends from a pitch lag value range of approximately 17 samples to 33 samples and the third pitch lag range 112 extends from a pitch lag value of approximately 91 samples to 148 samples of the input speech signal. The second pitch lag range 110 has a generally constant resolution of approximately 5. The third pitch lag range 112 has a generally constant resolution of approximately one.

In accordance with the illustrative example shown in FIG. 3, the first pitch lag range 111 and the associated first resolution range 102 collectively define a region 113 that contains a generally linear segment 115 of resolution of the excitation vector data versus pitch lag that approximately conforms to the following equation:

$$R_L=\epsilon/(y+\eta(L^{-1}-k))$$

where $R_L$ is the resolution at pitch lag L, L falls within the first resolution range, $L^{-1}$ represents previous pitch lag value with respect to the pitch lag L; $\epsilon$, $\eta$, and y represent constants or variables that are functions of a slope of the pitch lag versus resolution, and k represents a lower-bound value of the first resolution range.

Consistent with the illustrative example of the region 113 of FIG. 3, L falls within a range from approximately 33 to approximately 91 samples (e.g., 34 to 90 samples); $\epsilon$ is 58; y is 11.6; $\eta$ is 0.8, and k is 33. At a pitch lag L of approximately 91 between the resolution of 1 and 2, $R_L$ versus L may be modeled as a step function or otherwise. Although the validity of the foregoing equation is limited to the above range of L, in other embodiments other values of L may fall within the region 113 and other equations may fall within the scope of the invention. Further, the above equation may change slightly for a lower coding rate (e.g., half-rate coding) versus a higher-rate coding scheme (e.g., full rate).

Figure 4:
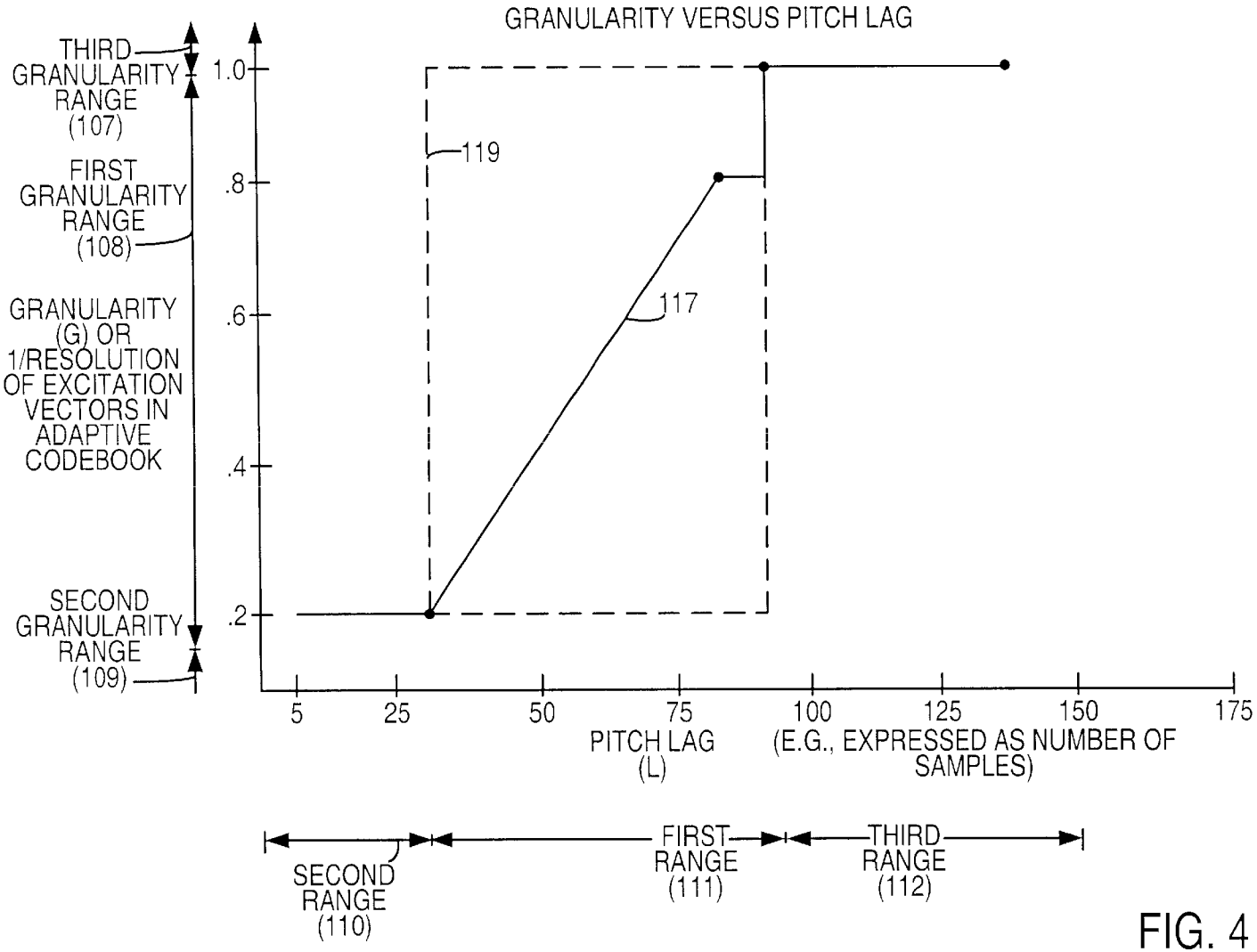
FIG. 4 is a graph of step-size versus pitch lag.

FIG. 4 shows the granularity of the excitation vectors versus the pitch lag. Like elements in FIG. 3 and FIG. 4 are labeled with like reference numbers. The vertical axis represents the granularity of the excitation vectors, which is equivalent to the reciprocal of the resolution of the excitation vectors. The horizontal axis represents pitch lag. The units on the horizontal axis may comprise a number of samples or another measure of time.

In general, granularity of the excitation vector data versus values of the pitch lag values may be expressed as relationships with reference to granularity ranges or pitch lag ranges. The first granularity range 108 includes a granularity that varies with pitch lag in a generally continuously variable manner over a first range 11 of pitch lags. A region 119 is defined by the association of the first granularity range 108 and the first pitch lag range 111. The first granularity range 108 is bounded by a second granularity range 109 of generally constant granularity (versus pitch values) and a third granularity range 107 of another generally constant granularity (versus pitch values). The second granularity range 109 is associated with lower pitch lag values of a second range 110 and a third granularity range 107 is associated with higher pitch lag values of a third range 112. The granularity level of the lower pitch lag values in the second pitch lag range 110 is less than the granularity of the higher pitch lag values in the third pitch lag range 112.

In accordance with the example which is illustrated in FIG. 4, the first granularity range 108 contains a generally linear segment 117 of granularity versus pitch lag that approximately conforms to the following equation:

$$G_L=\mu+\frac{\eta(L^{-1}-k)}{\varepsilon},$$

where $G_L$ is the granularity at pitch lag L, L falls within the first resolution range, $L^{-1}$ represents previous pitch lag value with respect to the pitch lag L; $\epsilon$, $\eta$, and $\mu$ represent constants or variables that are functions of a slope of the pitch lag versus resolution, and k represents a lower bound value of the first resolution range.

Consistent with the illustrative example of a region 119 of FIG. 4, L falls within the range from approximately 33 to approximately 91 samples (e.g., 34 to 90 samples); $\epsilon$ is 58, $\eta$ is 0.8, k is 33, and $\mu$ is 0.2. At a pitch lag L of approximately 91 between the granularity of 0.8 and 1, $G_L$ versus L may be modeled as a step function or otherwise. Although the validity of the foregoing equation is limited to the above range of L, in other embodiments other values of L may fall within a region 119 and other equations may fall within the scope of the invention. Further, the above equation may change slightly for a lower coding rate (e.g., half-rate coding) versus a higher-rate coding scheme (e.g., full rate).

In an alternate embodiment, a granularity associated with the lowest one-third of the pitch lag values is less than a granularity associated with the highest one-third of the pitch lag values, as opposed to the division of pitch lag ranges shown in FIG. 4, such that perceived reproduction quality of the speech signal is promoted.

The relationships expressed in FIG. 3 and FIG. 4 may apply to higher-rate coding (e.g., full-rate coding), where the detector determines that the input speech signal is generally stationary and voiced. If the detector determines that the input speech is not both stationary and voiced, the encoder may or may not use the adaptive codebook 36 for the interval (e.g., frame).

A different relationship between granularity and pitch lag may apply to lower-rate coding (e.g., half-rate coding), rather than the relationship shown in FIG. 3 or FIG. 4. For example, for half-rate coding the pitch lags may only be considered within a range of 17 samples to 127 samples, as opposed to the 17 to 148 samples of full-rate coding as shown in FIG. 3 or FIG. 4.

The system for coding speech increases the resolution of excitation vectors associated with lower pitch lag values and other pitch lag values within the intermediate range (e.g., first range 111) to increase the accuracy of speech reproduction in a perceptually significant manner. The increased resolution of the excitation vectors associated with the intermediate pitch lag range of the speech allows greater accuracy in voice reproduction. Thus, the excitation vectors associated with the intermediate pitch lag range of the speech tend to more accurately model the speech signal than the excitation vectors associated with the outlying spectral components outside of the intermediate pitch lag range (e.g., outlying components associated with the second range 110 and the third range 112). Nevertheless, the overall resolution and granularity of FIG. 3 and FIG. 4, respectively, support a perceptually adequate representation of the outlying spectral components of the speech signal outside the intermediate pitch lag range. Further, because any error caused by lack of resolution of the excitation vectors is less perceived at higher pitch lag values or outside of the intermediate pitch lag range, the quality of the reproduced speech is enhanced without sacrificing bandwidth of the air interface.

The adaptive codebook 36 may be applicable to an encoder that supports a full-rate coding scheme, a half-rate coding scheme, or both. Further, the adaptive codebook may be applied to different data structures or frame types at a full-coding rate or a lower coding rate.

Although the adaptive codebook 36 is predominately described with reference to the encoder 11, the decoder 70 contains a duplicate version of the adaptive codebook 36. Accordingly, the invention described herein applies to decoders and decoding methods as well as encoders and encoding methods. The same enhanced adaptive codebook may be used at both the encoder and the decoder to increase the perceived quality of the reproduced speech signal.

Figure 5:
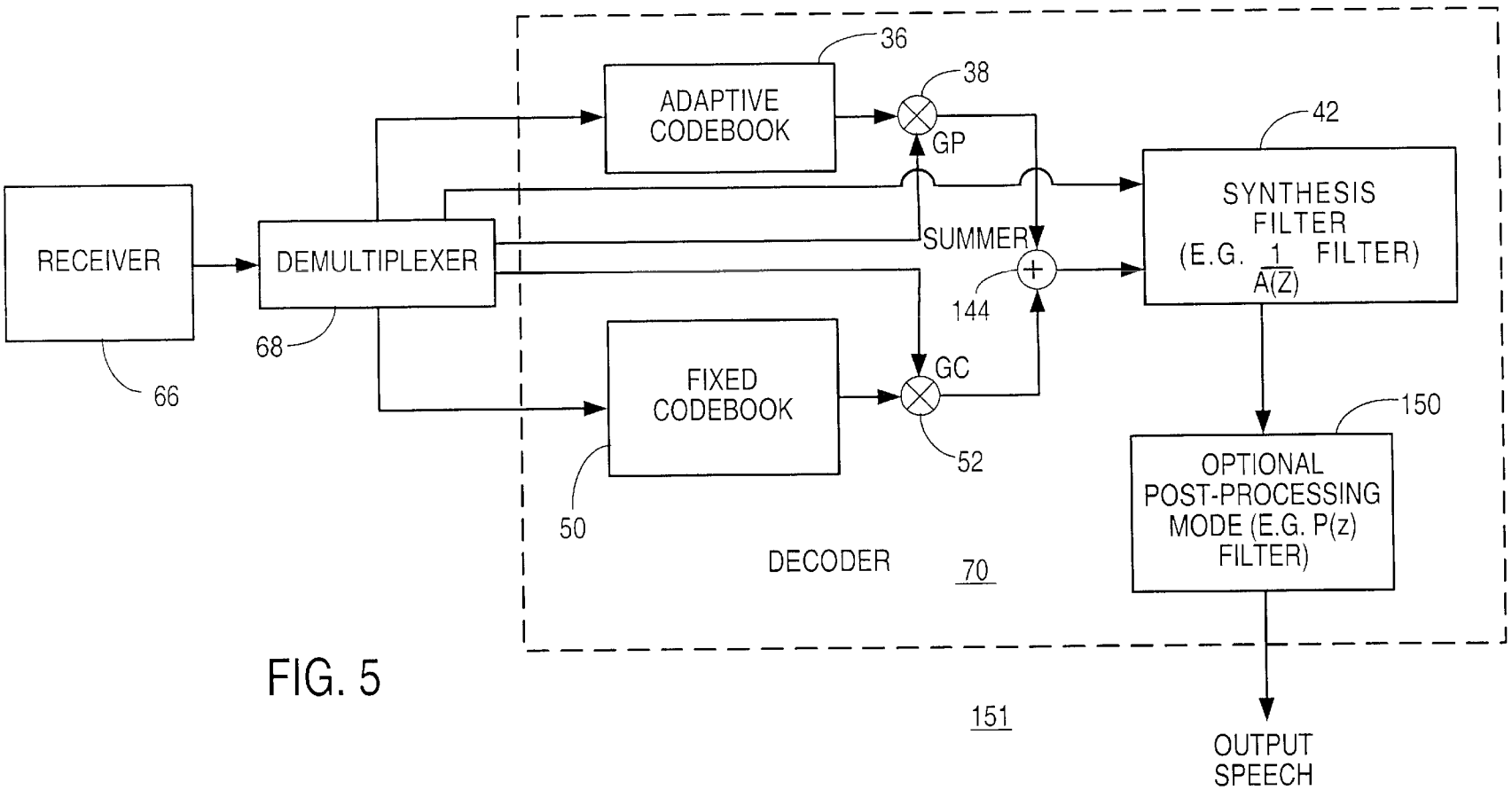
FIG. 5 is a block diagram of a decoding system.

FIG. 5 is a block diagram of an illustrative decoding system 151. The decoding system 151 may use components that are similar to or identical to those of the encoder of FIG. 1. However, the decoding system 151 does not require a minimizer (e.g., minimizer 48) as does the encoding system of FIG. 1. Like elements of FIG. 1 and FIG. 5 are indicated by like reference numbers.

The decoding system 151 includes a receiver 66 that is coupled to a demultiplexer 68. In turn, the demultiplexer is coupled to a decoder 70. The demultiplexer 68 provides coding parameters to various components of the decoder 70 to decode an encoded speech signal that the receiver 66 receives from an encoder (e.g., encoder 11).

The decoder 70 includes an adaptive codebook 36, a fixed codebook 50, a first gain adjuster 38, and a second gain adjuster 52. The demultiplexer 68 provides the coding parameters (e.g., adaptive codebook indices and fixed codebook indices) that are used to retrieve various excitation vectors from the adaptive codebook 36 and the fixed codebook 50. The first gain adjuster 38 scales a magnitude of the excitation vector outputted by the adaptive codebook 36 to scale the excitation vector by an appropriate amount determined by a coding parameter. Similarly, the second gain adjuster 52 scales a magnitude of the excitation vector outputted by the fixed codebook 50 to scale the excitation vector by an appropriate amount determined by the coding parameter. The summer 144 sums the scaled first excitation vector and the scaled second excitation vector to provide an aggregate excitation vector for application to the synthesis filter 42. The synthesis filter 42 outputs a reproduced or synthesized speech filter based on the input of the aggregate excitation vector and coding parameters provided by the demultiplexer.

The decoder 70 may include an optional post-processing module 150, which is indicated by the dashed box labeled in FIG. 5. The post-processing module 150 may include filtering, signal enhancement, noise modification, amplification, tilt correction, and any other signal processing that can improve the perceptual quality of synthesized speech. In one embodiment, the post-processing module decreases the audible noise without degrading the speech information of the synthesized speech. For example, the post-processing module 150 may comprise a digital or analog frequency selective filter that suppresses frequency ranges of information that tend to contain the highest ratio of noise information to speech information. In another example, the post-processing module 150 may comprise a digital filter that emphasizes the formant structure of the synthesized speech.

While various embodiments of the invention have been described, it will be apparent to those of ordinary skill in the art that many more embodiments and implementations are possible that are within the scope of this invention. Accordingly, the invention is to be defined broadly in light of the attached claims and their equivalents.

The following is claimed:

1. A system for coding a speech signal, the system comprising:

an adaptive codebook containing excitation vector data associated with corresponding adaptive codebook indices, a resolution of the excitation vector data versus values of the adaptive codebook indices varying in accordance with a plurality of resolution levels, including a first resolution range having generally continuously variable resolution levels within a corresponding first pitch lag range;

a gain adjuster for scaling selected excitation vector data from the adaptive codebook; and a synthesis filter for synthesizing a synthesized speech signal in response to an input of the scaled excitation vector data;

wherein the plurality of resolution levels further includes a second resolution range having generally constant resolution levels within a corresponding second pitch lag range, and wherein the first resolution range is bounded by and outside of the second resolution range.

2. The system according to claim 1 wherein the generally continuously variable resolution levels vary from one another throughout at least a majority of a first pitch lag range.

3. The system according to claim 1 wherein the generally continuously variable resolution levels vary from one another throughout a substantial entirety of the first pitch lag range.

4. The system according to claim 1 further comprising:

a minimizer for minimizing a residual signal formed from a combination of the synthesized speech signal and a reference speech signal, where the system is organized to form an encoder.

5. The system according to claim 1 where the first pitch lag range comprises an intermediate pitch lag range associated with the adaptive codebook indices, the intermediate pitch lag range affiliated with a generally linear segment defining a resolution of the excitation vector data versus corresponding pitch lag values.

6. The system according to claim 5 where the generally linear segment is sloped to provide a higher resolution of the excitation vector data for lower pitch lag values and a lower resolution of the excitation vector data for higher pitch lag values.

7. The system according to claim 1 where the second pitch lag range includes lower pitch lag values than those of the first pitch lag range, the second pitch lag range having at least one resolution level equal to or higher than the generally continuously variable resolution levels of the first pitch lag range.

8. The system according to claim 1, wherein the plurality of resolution levels further includes a third resolution range having generally constant resolution levels within a corresponding third pitch lag range, and wherein the first resolution range is bounded by the second resolution range at one end and the third resolution range at the other end.

9. The system according to claim 8 where the third pitch lag range includes higher pitch lag values than those of the first pitch lag range, the third pitch lag range having at least one resolution level equal to or lower than the generally continuously variable resolution levels of the first pitch lag range.

10. The system according to claim 1 where the adaptive codebook supports a plurality of ranges of pitch lags, including the first pitch lag range spanning intermediate pitch lag values, the second pitch lag range covering lower pitch lag values and a third pitch lag range covering higher pitch lag values, where the resolution level of excitation vectors affiliated with the second pitch lag range exceeds the resolution levels of excitation vectors affiliated with the third pitch lag range.

11. The system according to claim 1 where the first pitch lag range and the associated first resolution range collectively define a region that contains a generally linear segment of resolution of the excitation vector data versus pitch lag that conforms to the following equation:

$$R_L=\epsilon/(y+\eta(L^{-1}-k))$$

where $R_L$ is the resolution at pitch lag L, L falls within the first resolution range, $L^{-1}$ represents previous pitch lag value with respect to the pitch lag L; $\epsilon$, $\eta$, and y represent constants that are functions of a slope of the pitch lag versus resolution, and k represents a lower-bound value of the first resolution range.

12. The system according to claim 1 where the first pitch lag range and the associated first resolution range collectively define a region that contains a generally linear segment of granularity of the excitation vector data versus pitch lag that conforms to the following equation:

$$G_L = \mu + \frac{\eta(L^{-1} - k)}{\varepsilon}$$

where $G_L$ is the granularity at pitch lag L, L falls within the first resolution range, $L^{-1}$ represents previous pitch lag value with respect to the pitch lag L; $\epsilon$, $\eta$, and $\mu$ represent constants that are functions of a slope of the pitch lag versus resolution, and k represents a lower-bound value of the first resolution range.

13. An encoder for encoding a speech signal, the encoder comprising:

an adaptive codebook containing excitation vector data associated with corresponding pitch lag values, a resolution of the excitation vector data versus values of the pitch lag values varying in accordance with a plurality of ranges of resolution levels, including a first resolution range of continuously variable resolution levels of the excitation vector data;

a gain adjuster for scaling selected excitation vector data from the adaptive codebook;

a synthesis filter for synthesizing a synthesized speech signal in response to an input of the scaled excitation vector data; and a minimizer for minimizing a residual signal formed from a combination of the synthesized speech signal and a reference speech signal;

wherein the plurality of ranges further includes a second resolution range having generally constant resolution levels, and wherein the first resolution range is bounded by and outside of the second resolution range.

14. The system according to claim 13 wherein the generally continuously variable resolution levels vary from one another throughout at least a majority of a first pitch lag range.

15. The system according to claim 13 wherein the generally continuously variable resolution levels vary from one another throughout a substantial entirety of the first pitch lag range.

16. The system according to claim 13 where the excitation vector data affiliated with the first pitch lag range has a higher resolution for lower pitch lag values and a lower resolution for higher pitch lag values.

17. The system according to claim 13 where the pitch lag values include a first pitch lag range, a second pitch lag range, and a third pitch lag range that collectively extend from a lower pitch lag value to an upper pitch lag value, where the lower pitch lag values is equal to or greater than approximately 15 samples and where the upper pitch lag value is less than or equal to approximately 175 samples of an input speech signal.

18. The system according to claim 13 where the first resolution range is associated with a corresponding first pitch lag range, the first pitch lag range extending from a pitch lag range of approximately 34 to approximately 90 samples of the input signal, a second pitch lag range extending from a pitch lag value range of approximately 17 samples to approximately 33 samples and a third pitch lag range extending from a pitch lag value of approximately 91 samples to approximately 148 samples of the input speech signal.

19. The system according to claim 13 where the pitch lag values in the second resolution range are associated with a corresponding generally constant resolution of approximately 5.

20. The system according to claim 13, wherein the plurality of ranges further includes a third resolution range having generally constant resolution levels, and wherein the first resolution range is bounded by the second resolution range at one end and the third resolution range at the other end, where the pitch lag values in the third resolution range are associated with a corresponding generally constant resolution of approximately one.

21. A decoder for decoding a speech signal, the decoder comprising:

an adaptive codebook containing excitation vector data associated with corresponding pitch lag values, a resolution of the excitation vector data versus values of the pitch lag values varying in accordance with a plurality of ranges of resolution levels, including a first resolution range of continuously variable resolution levels of the excitation vector data;

a gain adjuster for scaling selected excitation vector data from the adaptive codebook; and a synthesis filter for synthesizing a synthesized speech signal in response to an input of the scaled excitation vector data;

wherein the plurality of ranges further includes a second resolution range having generally constant resolution levels, and wherein the first resolution range is bounded by and outside of the second resolution range.

22. The system according to claim 21 wherein the generally continuously variable resolution levels vary from one another throughout at least a majority of a first pitch lag range.

23. The system according to claim 21 wherein the generally continuously variable resolution levels vary from one another throughout a substantial entirety of the first pitch lag range.

24. The system according to claim 21 where the excitation vector data affiliated with the first pitch lag range has a higher resolution for lower pitch lag values and a lower resolution for higher pitch lag values.

25. A method for coding a speech signal, the coding method comprising the following steps:

establishing an adaptive codebook containing excitation vector data associated with corresponding adaptive codebook indices, a resolution of the excitation vector data versus values of the adaptive codebook indices varying in accordance with a plurality of resolution levels, including a first resolution range of continuously variable resolution levels associated with a corresponding first pitch lag range;

scaling selected excitation vector data from the adaptive codebook; and synthesizing a synthesized speech signal in response to an input of the scaled excitation vector data;

wherein the plurality of resolution levels further includes a second resolution range having generally constant resolution levels within a corresponding second pitch lag range, and wherein the first resolution range is bounded by and outside of the second resolution range.

26. The method according to claim 25 further comprising:

minimizing a residual signal formed from a combination of the synthesized speech signal and a reference speech signal to select the selected excitation vector from the adaptive codebook.

27. The method according to claim 25 where the establishing step includes establishing the first pitch lag range as an intermediate pitch lag range associated with the adaptive codebook indices.

28. The method according to claim 25, wherein the plurality of resolution levels further includes a third resolution range having generally constant resolution levels within a corresponding third pitch lag range, and wherein the first resolution range is bounded by the second resolution range at one end and the third resolution range at the other end.

29. The method according to claim 25 where the establishing step includes establishing a generally linear segment of resolution versus pitch lag values in a region defined by the collective combination of the first pitch lag range and the first resolution range.

30. The method according to claim 29 where the first pitch range is associated with intermediate pitch lag values, the second pitch lag range is associated with higher pitch lag values and the third pitch lag range is associated with lower pitch lag values, where the resolution level of the of the lower pitch lag values in the second pitch lag range exceeds the resolution levels of the higher pitch lag values in the third pitch lag range.

31. The method according to claim 25 where the first pitch lag range and the first resolution collectively define a region containing a generally linear segment of resolution versus pitch lag that conforms to the following equation:

$$R_L=\epsilon/(y+\eta(L^{-1}-k))$$

where $R_L$ is the resolution at pitch lag L, L falls within the first resolution range, $L^{-1}$ represents previous pitch lag value with respect to the pitch lag L; $\epsilon$, $\eta$, and y represent constants that are functions of a slope of the pitch lag versus resolution, and k represents a lower bound value of the first resolution range.

32. The method according to claim 25 where the first pitch lag range and the first resolution collectively define a region containing a generally linear segment of granularity versus pitch lag that conforms to the following equation:

$$G_L = \mu + \frac{\eta(L^{-1} - k)}{\varepsilon}$$

where $G_L$ is the granularity at pitch lag L, L falls within the first resolution range, $L^{-1}$ represents previous pitch lag value with respect to the pitch lag L; $\epsilon$, $\eta$, and $\mu$ represent constants that are functions of a slope of the pitch lag versus granularity, and k represents a lower bound value of the first resolution range.

* * * * *